United States Patent [19]

Westerweller

[11] Patent Number: 4,539,720

[45] Date of Patent: Sep. 10, 1985

[54] PORTABLE PERSONAL STALL SHOWER

[76] Inventor: Constance D. Westerweller, 1800 Panda Way, Hayward, Calif. 94541

[21] Appl. No.: 520,308

[22] Filed: Aug. 4, 1983

[51] Int. Cl.[3] ..... A47K 3/23

[52] U.S. Cl. ..... 4/599; 4/596; 4/602; 4/603; 4/616

[58] Field of Search ..... 4/596, 602, 603, 616, 4/598, 599, 615

[56] References Cited

U.S. PATENT DOCUMENTS

| | | | |
|---|---|---|---|
| 3,606,618 | 9/1971 | Veech | 4/603 |
| 3,760,431 | 9/1973 | Schwibner | 4/616 |
| 4,413,363 | 11/1983 | Troiano | 4/603 X |
| 4,453,280 | 6/1984 | Greenleaf | 4/603 X |

FOREIGN PATENT DOCUMENTS

| | | | |
|---|---|---|---|
| 84929 | 1/1896 | Fed. Rep. of Germany | 4/602 |
| 230197 | 1/1911 | Fed. Rep. of Germany | 4/603 |
| 2425223 | 1/1980 | France | 4/616 |

*Primary Examiner*—Henry K. Artis

*Attorney, Agent, or Firm*—Linval B. Castle

[57] ABSTRACT

A lightweight portable shower foldable into a backpack for campers or the like. A pliable water storage bag lies on a floor unit that also supports a vertical, sectioned, standpipe having a valved showerhead at the top. An annular curtain rod is held in a horizontal position by a hooking device at the top of the standpipe and supports a tubular shower curtain that is elastically connected to a rigid footpad atop the storage bag. In use, the weight of the user standing on the footpad provides water pressure to force water through the standpipe and showerhead. The elastic coupling to the footpad assures that the curtain will remain taut as water is forced from the storage bag.

10 Claims, 5 Drawing Figures

PORTABLE PERSONAL STALL SHOWER

BRIEF SUMMARY OF THE INVENTION

This invention relates to bathing appliances and in particular to a portable stall shower that is foldable into a small backpack configuration suitable for campers or the like.

Family camping is a popular activity engaged in by many people both in this country and abroad to either explore or vacation in remote unpopulated areas or have a relatively low cost holiday. There are, of course, many improved campsites with piped water, showers, and other sanitary facilities, but during peak holiday seasons the demands for such campgrounds exceed the supply and many campers are being forced to pitch their tents in camping areas without such full facilities. The more rugged and adventurous campers may hike or take pack trips into the wilderness to make their own campsite near fishing streams or in mountain hunting areas.

In established unimproved campgrounds or in the wilderness areas, washing or bathing facilities are most likely limited to a stream or nearby lake which, in the high elevations, may be snow fed and nearly freezing even during the warm summer months. Unless there is a reasonably warm lake or stream available, it is quite likely that such campers will forego bathing and it is quite probable that many families who otherwise enjoy camping will therefore postpone a much needed vacation until improved campgrounds are available.

The invention disclosed herein will solve many of the above inconveniences or problems and will provide campers with a pressurized hot water stall shower that is portable and which folds into a conveniently small lightweight package that may form part of a camper's backpack.

Briefly described, the portable shower includes a pillow-shaped resilient water storage bag which, in use, is filled with hot water and placed on a floor unit which supports a lightweight water conduit or vertical standpipe having a valved shower head at the top. The water bag is connected to the standpipe and the thin rigid circular foot pad is placed on top of the bag. A shower curtain is mounted to a circular ring that is supported near the top of the standpipe and the lower end of the curtain is preferably attached by elastic cording to the periphery of the circular foot pad. The user lowers the curtain ring and curtain to enter the shower, then raises and re-attaches the ring to be enclosed within the curtain. When the shower head valve is opened, the weight of the user on the foot pad and water storage bag forces the hot water up through the standpipe and out the shower head.

DESCRIPTION OF THE DRAWINGS

In the drawings which illustrate a preferred embodiment of the invention.

DETAILED DESCRIPTION

Figure 1:
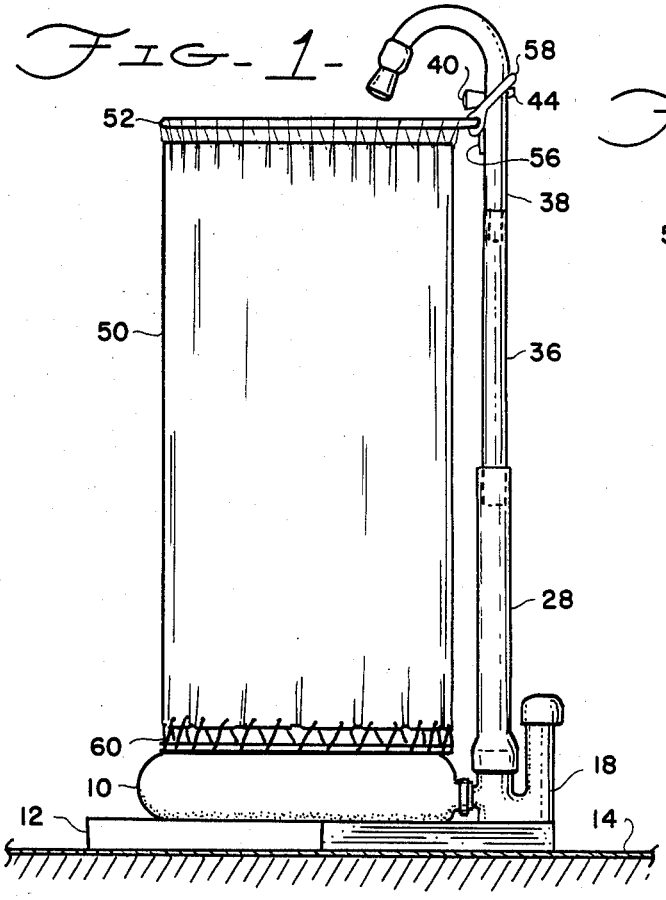
FIG. 1 is a side elevation view of the portable shower.
Figure 3:
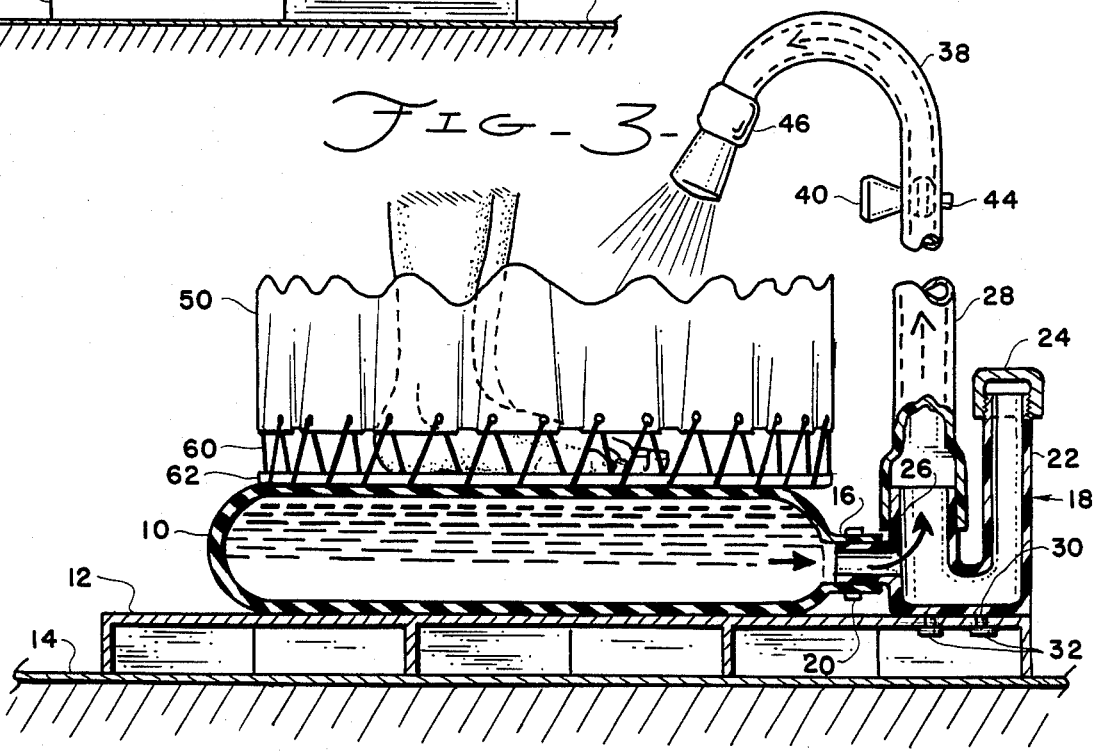
FIG. 3 is a sectional elevation view illustrating the construction of the lower portion of the portable shower.
Figure 4:
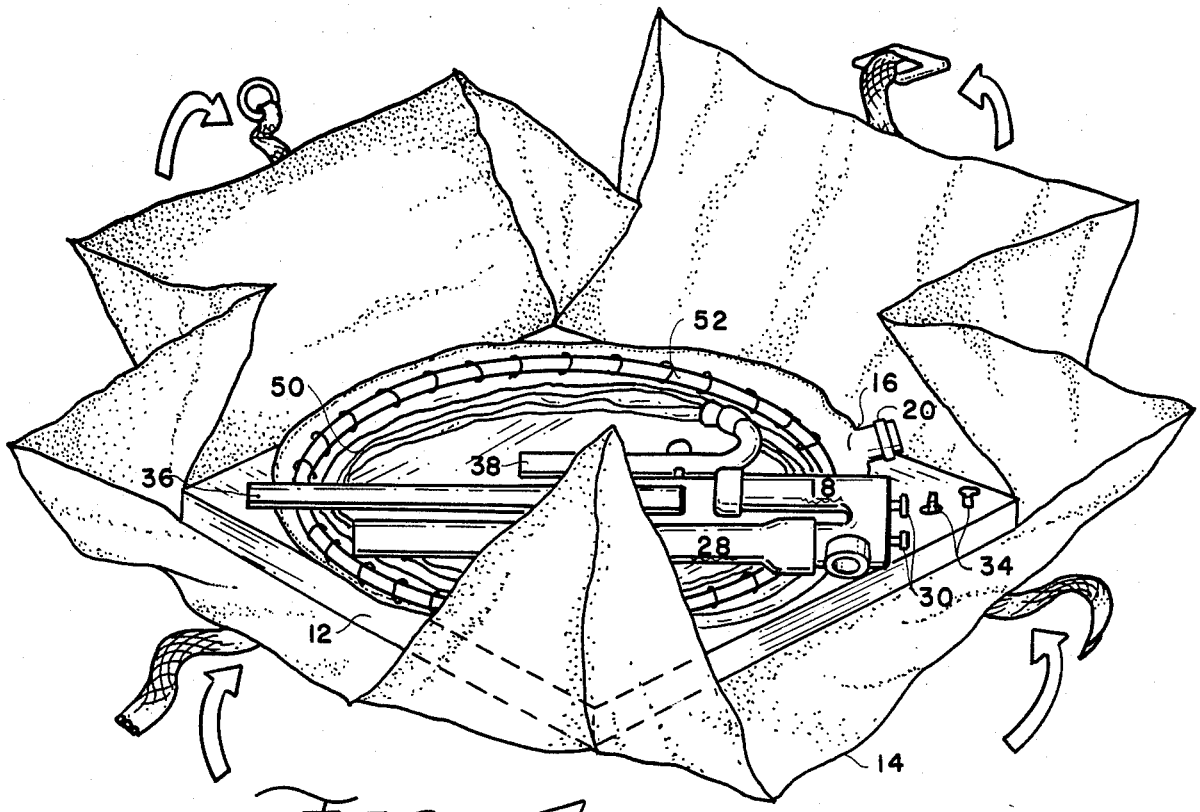
FIG. 4 is a perspective drawing illustrating the portable shower component stored in its ground cloth cover.
Figure 5:
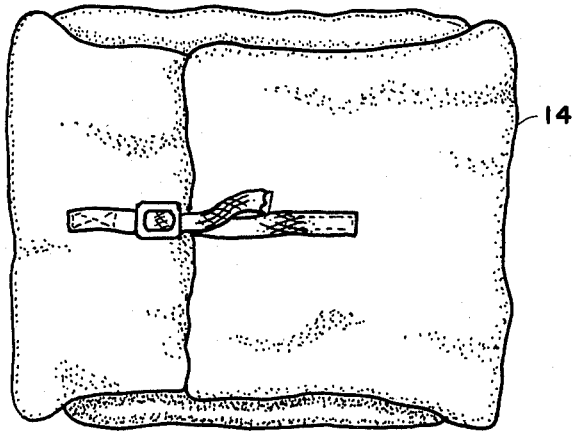
FIG. 5 is a plan view illustrating the shower packaged in its transporting backpack configuration.

FIG. 1 is an elevation view of the assembled stall shower illustrating a filled water storage bag 10 lying atop a floor unit 12 which is placed on a ground cloth 14 that also serves as a pack cover as shown in FIGS. 4 and 5. The floor unit 12 is preferably a rigid platform of approximately 22 to 24 inches square and approximately 1 inch in thickness and is preferably constructed of a thin lightweight frame with a generally smooth floor for supporting the bottom surface of the storage bag 12 as shown in FIG. 3.

Water storage bag 10 is a generally circular pliable rubber or plastic bag having, when filled, generally parallel top and bottom surfaces spaced by about 4 inches and with a diameter approximately the same as the 22 to 24 inch sides of the floor unit 12, thereby providing a supply of about 6 to $6\frac{1}{2}$ gallons of hot shower water. The storage bag 10 has a radial opening provided with a pliable tubular extension 16 as best illustrated in FIG. 3. The extension may have an inside diameter of approximately $1\frac{1}{2}$ inches and is attached to the male extension of a fill tube section 18 and clamped thereto by a suitable "overcenter" or screw-type hose clamp 20.

Fill tube 18 is preferably U-shaped and formed of a suitable lightweight plastic. One leg 22 of fill tube 18 terminates at a level higher than the top surface of the water storage bag 10 and is provided with a suitable screw-type cap 24 which may be removed to refill the water storage bag 10. The second leg 26 of fill tube 18 is branched; one branch being the male extension to the storage bag 10 and the second branch being a vertical section that connects to the lower section of the shower standpipe 28, as will be subsequently explained.

The bottom surface 30 of the fill tube 18 is flat to conform to the surface of the floor unit 12 and is preferably rigidly connected thereto by a pair of flat headed plastic or metal bolts 32 which extend down from the bottom surface 30 of the fill tube 18. The shank lengths of the bolts 32 that extend from the bottom surface 30 are approximately equal to the thickness of the floor of floor unit 12. As best illustrated in FIG. 4, one corner of the floor unit 12 is provided with a pair of oppositely faced keyhole-shaped openings 34, the large opening portion of which will accommodate the flat heads of the bolts 32 and the narrow sections of which will accommodate the shanks of the bolts 32. Therefore, to install the fill tube 18 on the floor unit 12 it is only necessary to insert the heads of the bolts 32 through the large diameter sections of the keyhole apertures 34 and then slightly twist the fill tube 18 so that the enlarged flat heads of the bolts 32 will firmly lock beneath the narrow sections of the keyhole apertures.

As previously mentioned, the vertical leg 26 of the fill tube 18 is connected to the lower portion 28 of the shower standpipe. In the preferred embodiment, the lower end of section 28 is expanded to provide a female friction fit to the exterior surface of the fill tube leg 26. While friction fit is acceptable for most applications, it may be desirable to provide a bayonet connection between the expanded end of tube 28 and the fill tube leg 26. Connected to the top end of the standpipe 28 is a second section 36 of the standpipe. Section 36 may be connected to the top end of the pipe 28 either by a friction fit as illustrated in FIG. 1, or by a bayonet connection or, if desired, may telescope into the tube 28 and provide a watertight friction connection when extended as illustrated in FIG. 1. The top end of the standpipe extension 36 is connected to the bottom end of the shower head tube 38 by either a friction fit or bayonet connection as previously mentioned. As best illustrated in either FIGS. 1 or 3, the shower head tube 38 is provided with an in-line turncock valve 40 which preferably extends through the tubing 38 to provide a turncock handle on the shower head side of the tube 38 and a valve axis peg 44 extending from the back of the tube 38. The portion above the valve unit 40 is curved forward and a suitable shower head 46 is attached to the end. In the preferred embodiment, the total length of the standpipe including the sections 28, 36 and 38 is approximately 5½ feet when assembled as illustrated in FIG. 1.

Figure 2:
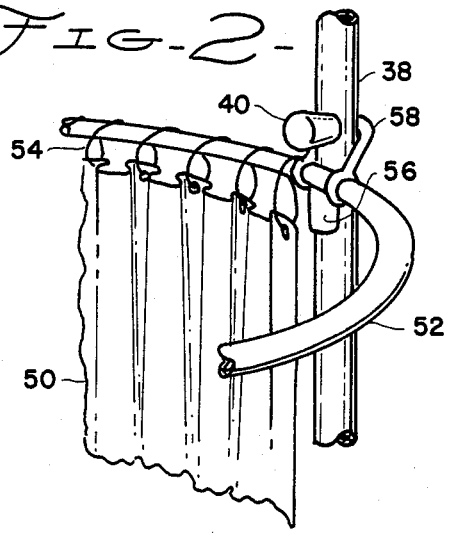
FIG. 2 is a perspective view illustrating the attachment of the shower curtain ring to the standpipe.

As illustrated in FIGS. 1–3, the stall shower of the invention is provided with a lightweight tubular shower curtain 50 approximately 20 inches in diameter and 4 to 4½ feet in length. Shower curtain 50 is supported at its top end by an annular curtain rod or ring 52 of substantially the same diameter as curtain 50 and is connected thereto by suitable cording 54 as best illustrated in FIG. 2. Curtain ring 52 is maintained in a generally horizontal position by a rigid downward turned lip 56 attached to the periphery of the ring 52 at an angle substantially normal to the plane of the ring and adapted to brace against the side of standpipe section 38. A generally U-shaped connecting clevis 58 is pivotally connected around the curtain ring 52 and adjacent each side of the lip 56 and is of sufficient length to hook over the extension provided by the valve axis peg 44 to thereby retain the curtain ring 52 and its curtain 50 in a generally horizontal plane as illustrated in FIGS. 1 and 2.

The bottom end of the tubular shower curtain 50 is connected by elastic laces or cording 60 to a generally circular foot pad 62 which is preferably a rigid, circular, lightweight pad that is placed atop the water storage bag 10.

In operation, the stall shower unit is assembled by first spreading a ground cloth 14 on a substantially level section of ground to provide both a clean base for the stall shower and a bath mat for the occupant. Floor unit 12 is then placed on the ground cloth and the fill tube 18 is mounted thereon by inserting the flat head bolts 32 through the mating keyhole apertures 34 and slightly twisting to provide a firm lock. Water storage bag 10 is then attached to the fill tube 18 and the standpipes 28, 36 and 38 are threaded through the connecting ring 58 and the curtain ring 52 and attached to the vertical leg 26 of the fill tube 18. Foot pad 62, curtain 50 and its curtain ring 52 are laid atop the surface of the water storage bag 10, fill tube cap 24 is removed and one or two buckets of hot water are poured into the leg 22 of the fill tube and therefore into the water storage bag 10. When cap 24 is replaced on the fill tube, the user steps on the foot pad 62 and raises the curtain ring 52 and curtain 50 to hook the connecting clevis 58 over the valve axis peg 44 as shown in FIG. 1. The weight of the person on the foot pad 62 provides the necessary water pressure so that when valve 40 is opened, the hot water from storage bag 10 will pass up through the standpipe sections and out the shower head 46. It will be noted that as water is depleted from the storage bag 10, the foot pad 62 will lower accordingly. The elastic cording 60 connecting the bottom of the shower curtain 50 to the foot pad 62 will stretch and, very important in outside showers, will keep the shower curtain sufficiently taut so that it will not uncomfortably cling to the body of the occupant or provide embarrassment by being blown open by unexpected breezes.

FIGS. 4 and 5 illustrate the components of the stall shower being folded into a backpack configuration. As illustrated in FIG. 4, the ground cloth 14 provides an overall cover for the pack. The floor unit 12 provides the necessary base or pack frame and the remaining components are laid atop the floor unit 12. Both pairs of opposite sides of the ground cloth 14 are provided with suitable web straps and buckles so that a first pair of opposite sides are first folded over and buckled to be followed by the folding of the second opposite sides and buckled to provide a pack as illustrated in FIG. 5.

Having thus described my invention, what is claimed is:

1. A portable personal bathing shower comprising:

a floor unit having a rigid, substantially flat top surface;

a pliable water storage bag positionable on said floor unit and having, when filled, generally parallel top and bottom surfaces, said bag having an opening in a side surface between said top and bottom surfaces;

a rigid fill tube removably attached to said floor unit, said fill tube having a first section adapted for removably connecting to said opening in said storage bag, a second section terminating at a level higher than the top surface of said storage bag, a removable watertight cap adapted to fit the end of said second section, and a third section having an end adapted to mate with the end of a vertical water conduit;

a shower head located in an elevated position above said water storage bag; and a water conduit coupled between said shower head and the end of said third section of said rigid fill tube for conducting water from said bag through said shower head by pressure created by the weight of a person standing on the top surface of said water storage bag.

2. The shower claimed in claim 1 whereby said water conduit comprises a plurality of rigid tubular sections having ends that mate with the ends of adjacent sections and with said shower head and said third section of said fill tube.

3. The shower claimed in claim 1 further including attachment means for locking said fill tube to the top surface of said floor unit, said attachment means including at least two bolts extending downward from the bottom surface of said fill tube and a corresponding number of oppositely faced keyhole-shaped openings in said floor unit, said keyhole openings being spaced and positioned to receive said bolts and to lock said fill tube by a slight rotation of said fill tube about an axis normal to the plane of said floor unit.

4. The shower claimed in claim 1 further including a turncock valve in the topmost section of said water conduit.

5. The shower claimed in claim 1 further including a tubular shower curtain, a curtain rod for supporting the top end of said curtain, and retaining means for maintaining said curtain rod in a generally horizontal position near the top of said water conduit.

6. The shower claimed in claim 5 wherein said retaining means comprises a rigid, downward-turned lip connected to the periphery of said curtain rod for bracing against the side of one of said conduit sections, and a clevis member coupled to said curtain rod and straddling said lip for connecting over an extension extending from the opposite surface of one of said conduit sections.

7. The shower claimed in claim 6 wherein said opposite surface extension is an extension of a turncock valve in a conduit section, said valve having a peg radially extending from said conduit section on the side opposite said turncock.

8. The shower claimed in claim 5 further including a rigid footpad loosely overlying substantially the entire top surface of said water storage bag, and elastic means connecting said tubular shower curtain to said footpad for maintaining said curtain in a taut position.

9. The shower claimed in claim 8 wherein said elastic means is elastic lacing coupled to the bottom end of said curtain and to the periphery of said footpad.

10. The shower claimed in claim 5 further including a substantially rectangular ground cloth for supporting said floor unit, said ground cloth having interconnected fastening means on each pair of opposite edges, said ground cloth having dimensions suitable for covering the top and bottom surfaces of said floor unit with all remaining decoupled components of said shower stacked thereupon, whereby said shower may be packaged into a backpack configuration.

* * * * *